United States Patent [19]

Maris et al.

[11] Patent Number: 4,497,559

[45] Date of Patent: Feb. 5, 1985

[54] DISC FILM DEVELOPER

[75] Inventors: Wiltjie Maris, Cromer; Robert Moran, Narrabeen, both of Australia

[73] Assignee: Blanrima Pty. Ltd., Lismore, Australia

[21] Appl. No.: 523,676

[22] Filed: Aug. 16, 1983

[30] Foreign Application Priority Data

Aug. 25, 1982 [AU] Australia ..... PF5544

[51] Int. Cl.[3] ..... G03D 3/06; G03D 3/08

[52] U.S. Cl. ..... 354/316; 354/322; 354/324; 354/330

[58] Field of Search ..... 354/312, 316, 320, 322, 354/324, 329, 330

[56] References Cited

U.S. PATENT DOCUMENTS

| | | | |
|---|---|---|---|
| 2,544,644 | 3/1951 | Allen | 354/322 |
| 4,011,573 | 3/1977 | Braico | 354/329 |
| 4,112,452 | 9/1978 | Patton | 354/322 |
| 4,112,453 | 9/1978 | Hutchison | 354/330 |
| 4,112,454 | 9/1978 | Harvey | 354/330 |
| 4,167,320 | 9/1979 | Hutchinson | 354/323 |
| 4,178,091 | 12/1979 | Solomon | 354/322 |
| 4,188,106 | 2/1980 | Harvey | 354/330 |
| 4,252,430 | 2/1981 | Michal | 354/322 |
| 4,290,687 | 9/1981 | Takahashi | 354/320 |
| 4,410,257 | 10/1983 | Thebault | 354/316 |

FOREIGN PATENT DOCUMENTS

| | | | |
|---|---|---|---|
| 1149784 | 12/1957 | France | 354/320 |

*Primary Examiner*—A. A. Mathews

*Attorney, Agent, or Firm*—Holman & Stern

[57] ABSTRACT

A film disc developing machine, for developing plastic film discs coated on one side with a photographic emulsion enclosed in a housing and having a hub portion with a central hole, in which a film disc to be processed is held in a substantially horizontal position in a light type casing the machine, from which it is picked up on the end of one of a number of downwardly projecting spindles movable around a closed path. The spindles are moved intermittently around this path by mechanisms which raise and lower the spindles intermittently, indexing the whole assembly through a predetermined angle in the raised position; each time the spindles are lowered the lower end of the spindle passes through the hole in the hub of a film disc to engage it frictionally. Beneath the path of the spindles a plurality of processing solution containers are arranged including at least one container for drying. A film disc picked up on the end of a spindle is thus introduced into each processing solution in turn and retained in it for a predetermined period so that on completion of its travel around the path the film disc is fully processed and dried. The spindles are rotated about their axes by a common drive to enhance contact between the emulsion and the processing solutions and preferably a film disc in the drying container is rotated at a higher speed to throw off surplus solution.

11 Claims, 11 Drawing Figures

FIG. 7
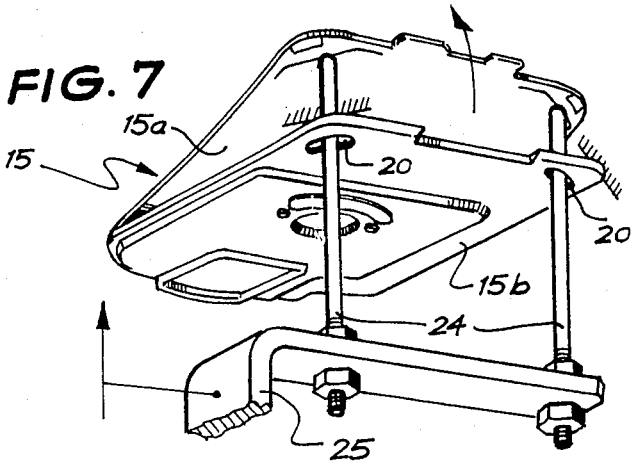
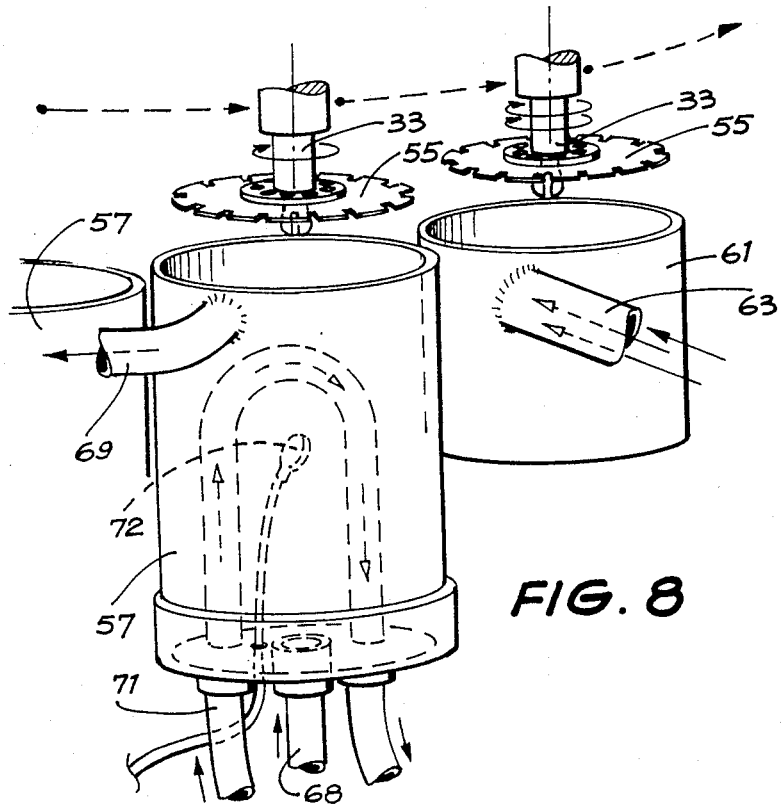
FIG. 8

DISC FILM DEVELOPER

BACKGROUND OF THE INVENTION

1. Field of the Invention

The present invention relates to a film disc developing machine intended for the developing of film discs such as those described in U.S. Pat. No. 4,194,822 or Australian Patent Specification No. 519,642.

2. Description of the Prior Art

The abovementioned specifications describe a photographic cartridge assembly which includes a two part casing with a film disc rotatably mounted therein. As the format of such a film disc is quite different from that of photographic films that are conventionally used in small cameras it has been necessary to devise special machinery for commercial quantity processing of such film discs. Before the film disc can be processed it is however necessary that it shall be removed from its container and the normal practice has been for this to be done manually in a suitable light tight enclosure and thereafter for each film disc to be transferred to a spindle constructed to carry a large number of such discs. In subsequent processing the spindle with the discs arranged on it is passed through a series of processing steps and all the film discs on the spindle are processed simultaneously. While this is quite satisfactory in normal commercial operation it is not satisfactory for use in what are known as "mini-labs" which offer customers a one hour service for the processing of films.

BRIEF SUMMARY OF THE INVENTION

The object of the present invention is to provide a disc film processing apparatus that in a preferred form is particularly suited for such use in that in it films are processed one by one or continuously.

The present invention consists in a film disc developing machine having a light-tight casing, means therein for supporting a film unit consisting of an emulsion bearing disc having a hub member secured thereto, with a central hole therein, in a substantially horizontal altitude, means supporting a plurality of vertically extending spindles arranged around a closed path passing over said hole, a plurality of photographic solution containers arranged below said spindles and in a path corresponding to said closed path, means for causing simultaneous relative vertical movements at predetermined intervals between both said means for supporting a film unit and said containers, and said spindles towards and away from each other whereby said spindles are caused to enter said solution containers and after a predetermined time are withdrawn from them and for moving said spindles, after each movement of said parts away from each other, a distance along said path corresponding to the spacing between adjacent spindles, one of said spindles being situated immediately above said hole during said relative vertical movements, the lower free end of each spindle being shaped to pass through said hole during movement of said parts towards each other and to engage frictionally in said hole, and support the film unit during processing, the arrangement being such that on each occasion that said parts are moved toward each other, film units are immersed in solutions in said containers and retained therein for a predetermined period before being removed from said solutions whereby, on having been immersed into each of said containers in turn, a film unit is completely developed, means for continuously rotating said spindles about their axes, means for detaching a developed film unit from a spindle and timing means controlling and synchronizing the operation of the machine.

It is preferred that a film disc developing machine as defined above shall have means for receiving a photographic cartridge assembly consisting of two shallow dished members secured together around their peripheries and containing said film unit, means for splitting said cartridge assembly apart and means for delivering said film unit to said means for supporting the film unit in a substantially horizontal position.

BRIEF DESCRIPTION OF THE DRAWINGS

In order that the invention may be better understood and put into practice a preferred form thereof is hereinafter described by way of example with reference to the accompanying drawings wherein:

FIG. 7 is a detailed perspective view showing the manner in which the cassette is opened; and FIG. 8 is a detailed perspective view showing adjacent processing and drying containers.

DETAILED DESCRIPTION

Figures 1, 3:
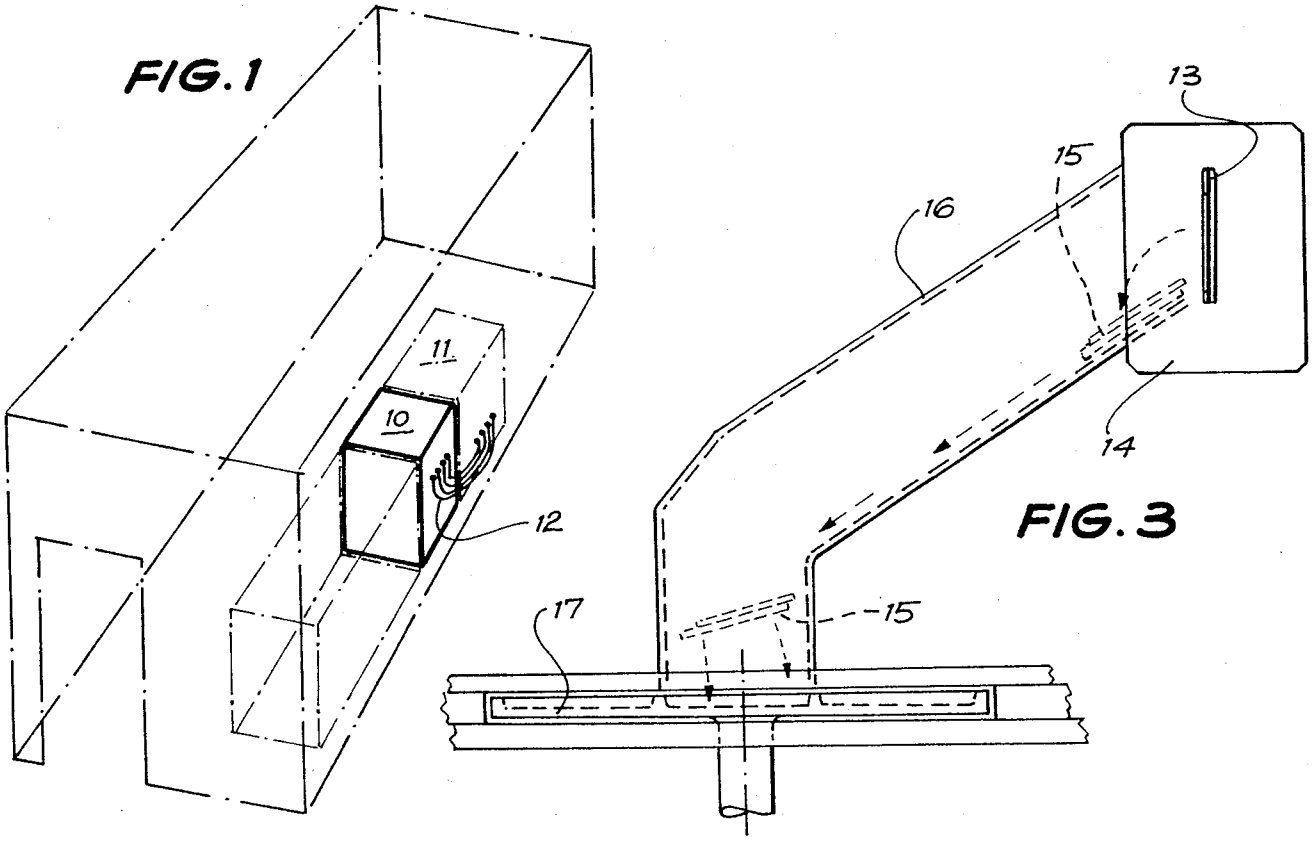
FIG. 1 is a diagrammatic representation of a "mini-lab" establishment showing the arrangement of a film disc developing machine according to the present invention in relation to the equipment normally at present provided in such an establishment.
FIG. 3 is a schematic view an enlarged scale of a slot on the front of a machine for receiving a film cartridge assembly including a film disc and of the chute down which the cartridge passes.

FIG. 1 shows schematically a "mini-lab" establishment in which a film disc developing machine 10 according to the invention 11 is arranged side by side with the normal developing equipment provided and with which it is linked by tubes 12. These tubes enable overflowing processing solutions from the developer 11 to be transferred to the film disc developing machine 10 for use and subsequent discard. With this arrangement each time a solution is discarded from the main machine it is fed to the appropriate solution container of the film disc developing machine displacing partly spent solution from that container. This is a very convenient arrangement, although not essential, in that a film disc developing machine according to the invention can be constructed with its own solution tanks. "mini-lab" premises are normally small and narrow and it is a feature of the preferred form of the invention that it can be readily accommodated in a restricted space.

The construction of a film disc developing machine according to the invention is best understood from a description of its mode of operation. Film discs which the machine is intended to process consist essentially of a disc of relatively rigid plastic sheet material having at its center a hub molded from plastic material, the hub having a central hole and other features not significant for an understanding of the present invention. The surface of the film disc carries light sensitive emulsion which, in a camera intended for use with such a disc, is exposed to light by operation of the camera and a series of latent images are produced around the surface of the disc by normal photographic methods.

The film disc is supplied in a light tight film cartridge which consists of a flat two-part casing made up of two molded plastic shells which are secured together around their peripheries. The shells each have in them a hole through which access can be obtained to the hole in the hub in the film disc. The two halves of the film cartridge are secured together around their circumferences by inter-engagement coupled with a small quantity of adhesive. In normal use the two halves remain joined and protect the film from exposure to light except when a portion of the film is exposed in a suitable camera. The two halves of the cartridge may be readily pried apart to remove the film disc and this is an essential preliminary to processing the film disc. It is the normal practice for containers to be opened by hand in light tight conditions and thereafter transferred manually to a keyed spindle which is subsequently transferred to a machine for development. A film disc developing machine in the preferred form described, however, provides for the automatic opening of such film cartridges in a manner described below.

Figure 2:
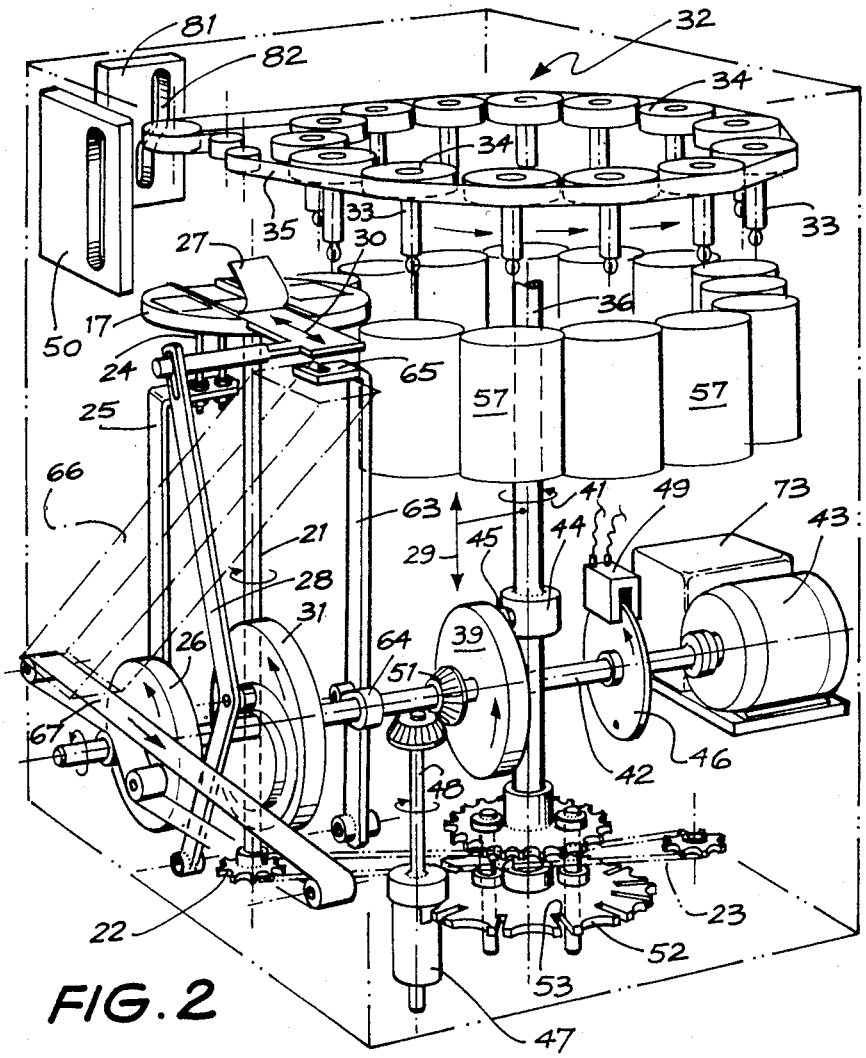
FIG. 2 is a partly diagrammatic perspective view of some of the working parts of a film disc developing machine according to the invention, other parts being omitted for clarity.

A film cartridge containing a film disc is received from a customer and is inserted into a slot 13 in a plate 14 in the face of the developing machine 10 which is the face on the left hand side in FIG. 2. The machine is contained in a light tight casing such that all processing of film discs is carried out in the dark. The slot 13 and the parts associated with it are not shown in FIG. 2 for the sake of clarity.

Figure 4:
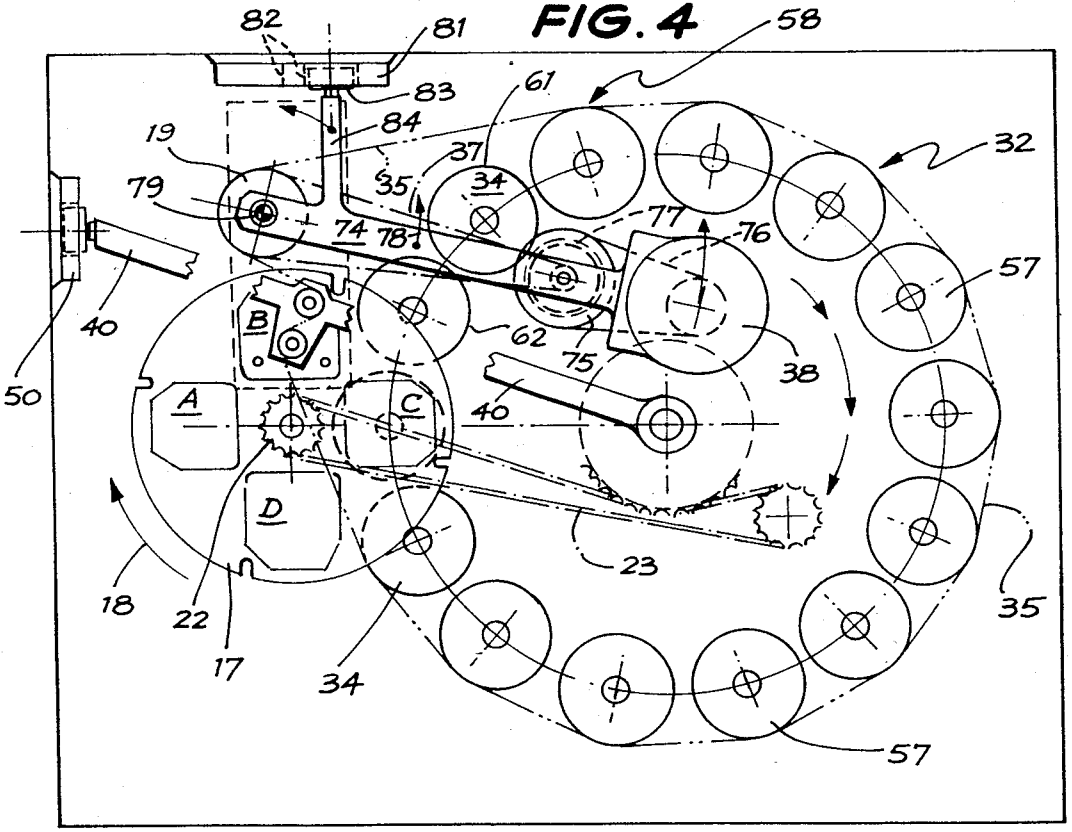
FIG. 4 is a partly schematic top plan view of the machine.

The slot 13 is constructed in such a manner that a film disc cartridge 15 can be inserted in it in one direction only. This ensures that the cartridge is in the correct position for subsequent operation and in particular that the emulsion bearing face of the film disc is downward. After insertion the cartridge 15 passes down the chute 16 by gravity onto the surface of the transfer disc 17, which disc has on it four stations A, B, C, D as indicated in FIG. 4. In the first instance the cartridge is delivered in a horizontal attitude on to station A. The first step in the processing of the film disc is the opening of the cartridge and the discarding of its two parts. These operations take place on the transfer disc 17, which is rotated in the direction of the arrow 18 by means of the shaft 21, which is driven through sprocket 22 and chain 23. Rotation of the disc is intermittent, it being moved through 90° during each partial rotation.

Figures 5A, 5B, 5C, 5D:
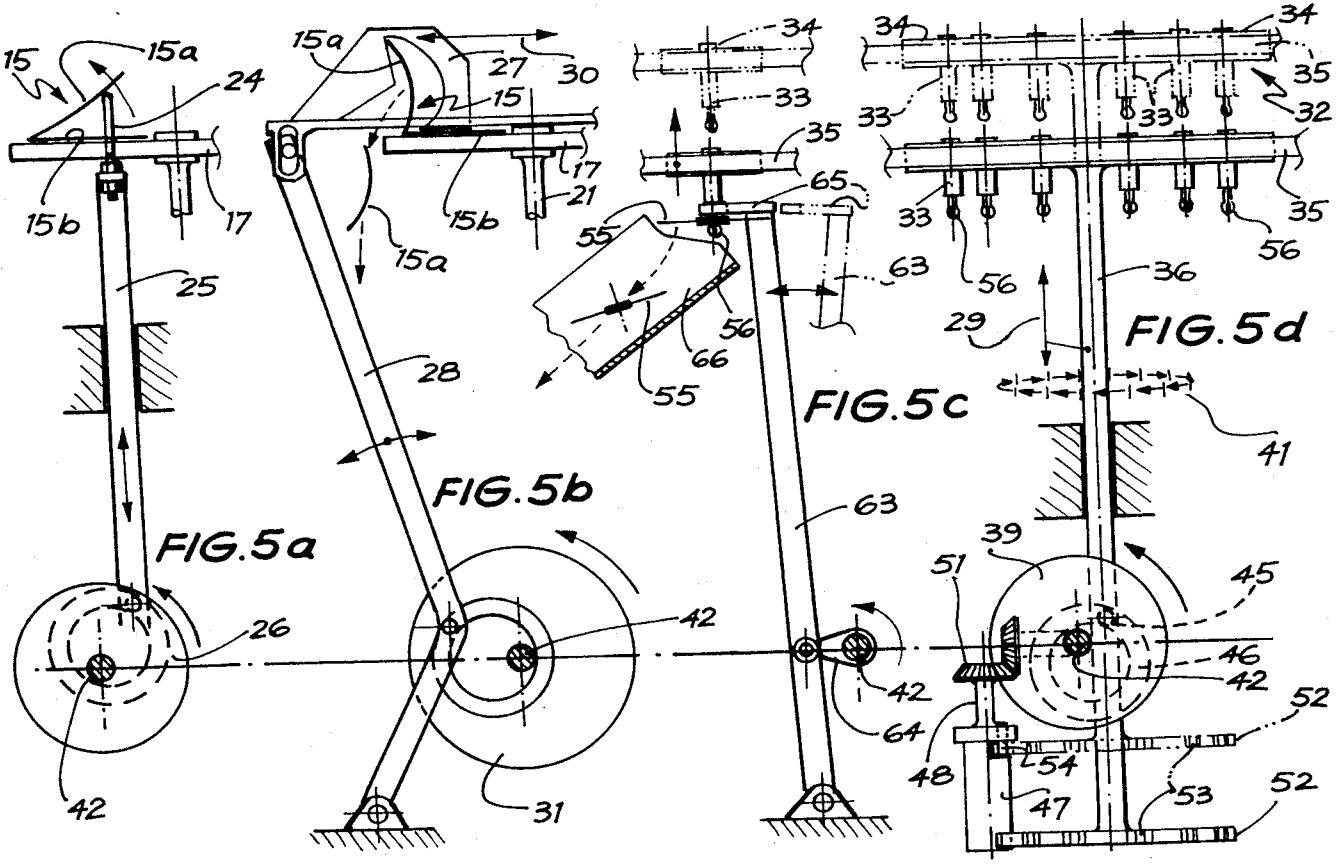
FIGS. 5(*a*), (*b*), (*c*) and (*d*) are schematic illustrations showing the manner in which the various parts of the machine function.

After a cartridge 15 has arrived at the station A on the disc 17 the first partial rotation moves it around to station B. At this station the two parts of the cartridge are split apart by means of a pair of pins 24 mounted on the upper end of a bar 25. The bar 25 is reciprocated by the action of the cam 26. As the bar 25 rises, pins 24 pass through holes 20 which are a feature of the bottom part 15*b* of the cartridge 15 and split the top part 15*a* of the cartridge 15 from the bottom part 15*b* as illustrated in FIGS. 5*a* and 7. While the cartridge 15 is still at station B the pins 24 are retracted and a slide 27 is moved across the cartridge to strip off the upper part 15*a* as illustrated in FIG. 5*b*. The slide is attached to the upper end of the bar 28 which is moved by the cam 31 which is rotated in a manner described below. The slide 27 reciprocates in the directions indicated by the arrow 30 in FIG. 2 and, in moving to the left in FIG. 5*b* strips off the top part 15*a* of the cartridge 15 which is ejected in the manner illustrated in FIG. 5*b* and falls to a suitable waste bin (not shown).

During the next partial rotation of the transfer disc 17 the bottom part 15(*b*) of the cartridge 15 with the film disc in it moves round to station C. At this station the film disc is removed from the bottom part 15*b* of the cartridge 15 in a manner described below. The next partial rotation of the transfer disc 17 moves the now empty bottom part 15(*b*) of the container 15 to position D where it is allowed to drop down a chute (not shown) to a suitable waste bin.

Processing of the film disc is carried out by means of a carousel indicated generally at 32 which consists of a frame which carries a plurality of independently rotatable spindles 33 each of which is associated with a pulley 34, all but three of the pulleys 34 being engaged by a common driving belt 35 which itself is driven by pulley 19 which in turn is driven through belt 37 from an electric motor 38. (The motor 38 and parts associated with it are omitted from FIG. 2 for clarity). The purpose of the belt 35 and pulleys 34 is to enable the spindles 33 to be rotated about their own axes for purposes described below.

The carousel 32 is supported on the vertical shaft 36 which is steadied by an arm 40 extending from a sliding bearing 50 in the casing of the machine. This shaft is subjected to axial movement in the direction of the arrows 29 by means of the cam 39 and to an intermittent rotary motion in the direction of the arrow 41. The cam 39 is driven through the shaft 42 from the main driving motor 43 which also serves to drive cams 26 and 31. A collar 44 on the shaft 36 has on it a pin 45 that lies within an annular groove on the cam 39; thus rotation of cam 39 causes reciprocation of the shaft 36.

Figure 6:
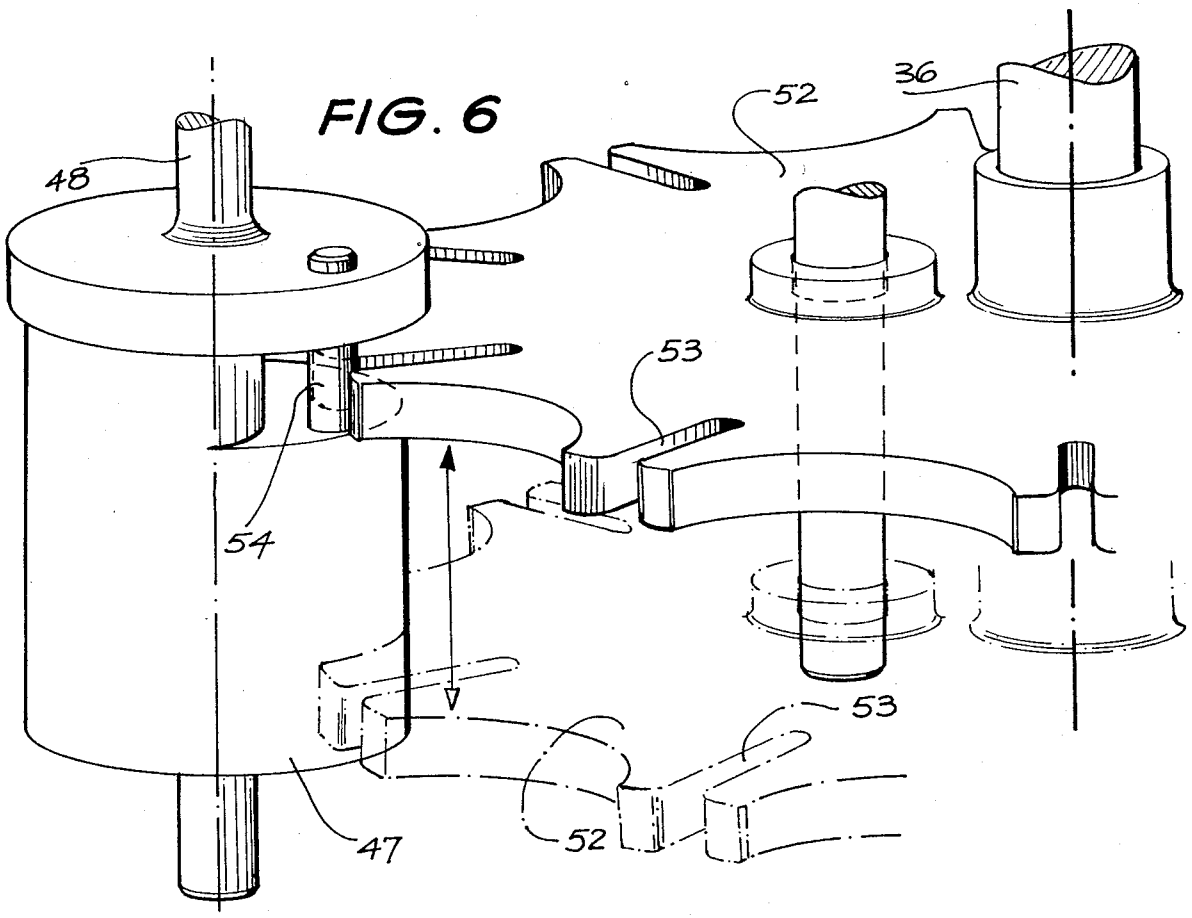
FIG. 6 is a detailed perspective view of a part of the Geneva mechanism and associated cam.

Intermittent rotation of the shaft 36 is produced by means of the geneva pinion 47 which is driven through the shaft 48 and bevel pinions 51 from the shaft 42. The geneva pinion 47 is associated with a geneva wheel 52 which is slidable in relation to the pinion 47 and engages with it in the manner illustrated in FIGS. 2 and 5*d*. In the upper position of geneva wheel 52, shown in FIGS. 5*d* and 6, one of the slots 53 engages a vertical pin 54 in the geneva pinion 47. Thus on each rotation of the pinion 47 the geneva wheel 52 is indexed through the angle made by adjacent slots 53.

Movement of the carousel 32 is controlled in the following manner. With the carousel in the fully down position as illustrated in full lines in FIG. 5*d* and the machine at rest, operation of a starting control (not shown) for the machine causes an electronic timer to time out 1.57 minutes after which the motor 43 is energized to drive the shaft 42. A sensor 49 operating in conjunction with a sensor disc 46 driven by shaft 42 gives an electrical indication every time the disc 46 turns through half a revolution. If, after one half revolution, all interlocks and safety switches referred to below are in their correct positions the motor will continue to be energized until one revolution is sensed. The motor 43 is then de-energized and the timer reset for a further 1.57 minutes. During rotation of the motor 43, shaft 36 will firstly be raised to the upper position indicated in chain lines in FIG. 5*d* and shaft 36 will then be indexed in the direction of the arrow 41 through an angle corresponding to adjacent slots 53 in the geneva wheel 52. Thereafter the shaft 36 is lowered to return the carousel 32 to the fully down position from which it started. The effect of these actions is that the carousel is raised, indexed through a predetermined angle and lowered every 1.57 minutes.

Whenever the carousel 32 is stationary one of the spindles 33 is immediately above station C of the transfer disc 17. At this station, there will be the lower part 15*b* of the cartridge with a film disc 55 lying horizontally in it, the top part 15*a* of the cartridge having been removed at station 3. In FIG. 2 the bottom part of the cartridge and the film disc have been omitted for clarity. Each time the carousel 32 is lowered, the end of a spindle 33 will enter the hole in the middle of a film disc 55. The lower end 56 of each spindle 33 is shaped and dimensioned in such a manner that it will pass through the hole in the film disc 55 and frictionally engage it in such a manner that when the carousel is next raised the film disc is carried up with the spindle leaving the bottom part 15*b* of the cartridge at station C of the transfer disc 17. As is best seen in FIG. 8, the lower end of each spindle 33 consists of a knob having in it an axially extending slit. The spindle, or such part of it as is immersed in the processing solutions is made of a material that is not corroded, by the solution perferably a plastic material such as delrin.

Processing of the film disc 55 is carried out in a series of solution containers 57 arranged in a circle beneath the locus of the spindles 33, as the carousel 32 is rotated. The containers 57 contain the various processing solutions required to develop, bleach and fix the film. As these are of a standard nature it is unnecessary to describe the chemistry of the developing process for an understanding of the present invention. The motion of the carousel 32 is such that each film disc after being picked up on a spindle 33 is lowered into a first developing tank 57. During this action the film disc is rotated by the action of belt 35 acting on pulley 34 of the spindle 33. It has been found that a desirable speed of rotation for the film discs is around 250 revolutions per minute. This enhances the contact between the film disc and the solution concerned to provide uniform and complete processing of the emulsion. Each time the carousel is indexed each film disc is moved over subsequent container 57 and is thereafter lowered into it for the next stage of processing.

In the arrangement shown there are ten containers 57 containing processing solutions, the first two containers containing developer, the next three containers containing bleach, the next three containers containing fixing solution and the last two container containing washing water. Accurate timing of the various stages of processing is essential and with the arrangement described set up for the processing of film by Eastman Kodak process C41 each film disc is immersed in each solution for 1.57 minutes.

The three containers indicated in FIG. 4 as 58, 61 and 62 are provided for stabilizing, drying and unloading, respectively developed film discs.

To assist drying in the container 61 a stream of heated air is provided through the gap 63 (FIG. 8). When a spindle 33 is positioned above the container 61 its rotation is stopped prior to the spindle being lowered into the container. Once in the container the spindle is rotated at an increased speed of around 3,675 revolutions per minute. It has been found that a relatively high speed is necessary in order to ensure that any chemical solution retained in the hub of the film disc is thrown out. If this is not done the developed film may have a streaky appearance.

The increased speed of rotation of the spindle 33 in this position is achieved by means of an arm 74 which carries a stepped pulley 75 driven from the motor 38 by belt 76. On its underside pulley 75 has a portion 77 of lesser diameter. Arm 74 can pivot in the directions of the arrow 78 about the pivot 79. When the arm 74 is at the clockwise limit of its movement the portion 77 of the pulley 75 makes frictional driving contact with the surface of the pulley 34, at that time above the drying container 61, and rotates the film disc on the spindle 33 at a speed of 3675 r.p.m. It is to be noted that at this time the pulley 34 concerned is not in contact with belt 35.

Movement of the arm 74 is effected by means of a cam 81 mounted on the casing of the machine consisting of a groove 82 having in it a joggle. A roller 83 moves in the groove 82 and is attached to the end of an extension 84 of the arm 74. The arrangement is such that each time shaft 36 is lowered the roller 83 is moved down the groove 82 which acts to move the roller 83 and then the arm 74 to cause the portion 77 of the pulley 75 to engage the pulley 34, at that time above the drying container.

After the spindle 33, with a film disc on it, has been lowered at the position 62, a lever 63 (FIG. 5*c*) is actuated by the cam 64 to move a slotted extension 65 of the lever 63 so that slot surrounds the end of the spindle 33 above the film disc 55 as shown in FIG. 5*c* and is retained in this position as the spindle is lifted, when the carousel 32 is raised. The effect of this is that the film disc 55 is detached from the spindle and is free to fall down the shoot 66 to fall onto a conveyor 67 where it is conveyed to a position from which it can be removed from the machine. In alternative forms of construction a plurality of discs may be arranged to be collected on a spindle passing through the holes in the discs, for subsequent treatment.

In the form of the machine illustrated containers 57 are intended to be supplied with appropriate chemical solutions by overflow from an existing processing machine as illustrated in FIG. 1. FIG. 8 illustrates one typical arrangement in which a solution is introduced into the container through the inlet pipe 68 and flows out of the upper end of the container through the outlet pipe 69 to waste. In some cases it is necessary to maintain the solutions at a predetermined temperature within close limits and for this purpose a liquid at an appropriate temperature may be passed through a pipe such as 71 passing through the interior of the container 57 and passage of this liquid controlled by a thermostatic device 72.

Instead of employing a number of containers for each of the steps of developing, bleaching and fixing each step may be carried out in a specially shaped container having a circumferential extension corresponding to two or three of the containers 57 illustrated.

The containers 57 may be provided with an upward extension above the level of solution in the container and arrangements may be made so that towards the end of the upward stroke of the shaft 36 the speed of the driving belt 35 is increased for a short time so as to spin off any residual solution adhering to the film discs. This helps to ensure that the amount of solution carried over from one container to the next is a minimum.

In order to oversee and coordinate the operation of the whole machine a control box 73 is provided which contains a timing device for regulating the operation of the motor 43 and with circuitry responsive to safety device and interlocks (not shown) arranged through the machine to prevent damage occuring to the machine should it be operated in an unsatisfactory condition. These arrangements are of a conventional nature and as details of these are not necessary for an understanding of the present invention for the sake of brevity and clarity they are omitted. The machine described above is particularly useful and convenient for operation in mini-labs in that as many cartridges as can be accomodated in chute 16 may be inserted and the machine run continuously until they are processed. Alternatively the machine will process a single film disc. The entire processing operation takes of the order of 30 minutes leaving about the same amount of time available for the printing of the film to enable a one hour service to be provided.

While the mechanism for opening film cartridges forms an integral part of the preferred embodiment of the invention described above it is within the scope of the invention to construct a machine omitting this portion. In this case opening of the cartridges would be carried out manually in a light tight compartment attached to the machine and the film disc inserted manually into a position corresponding to station C of the transfer disc. While this would simplify the construction of the machine it would introduce an additional labour element into the cost of processing.

While in the machine described the spindles are raised and lowered into the containers, it would be quite possible to construct a machine in which the spindles were maintained at the same height and instead, the containers and the film disc support at station C were raised and lowered. Such a machine would differ in mechanical detail but function in precisely the same manner as the preferred embodiment described above.

We claim:

1. A film disc developing machine for processing in a processing cycle film units each consisting of an emulsion bearing disc having a hub and a central hole through the hub comprising:

a light tight casing;

means for supporting a film unit with the plane of the disc substantially horizontal;

means for rotatably supporting a plurality of spaced vertically extending spindles arranged around a closed path which passes over said film unit supporting means;

a plurality of containers containing photographic solutions disposed below and spaced along a closed path corresponding to said path of said spindles;

means to move said spindle supporting means so that said spindles move along said path over said film unit supporting means and said containers;

means to continuously rotate said spindles about their axes when in the positions over said photographic solution containers;

a lower free end on each spindle shaped and adapted to be removably insertable into the hole in the hub of the film disc to frictionally retain said film disc therein;

means to cause relative vertical movement at predetermined intervals between said spindle supporting means and said containers and film unit supporting means so that when said spindles and film unit supporting means and containers are moved toward each other said lower end of one of said spindles engages within the hole in a film disc support means and the lower free ends of other of said spindles are immersed in the solutions in said solution containers, and when said spindles and film unit supporting means and containers are moved away from each other a film disc retained on the lower free end of said one spindle is raised off of said film unit support means and the lower free ends of said other of said spindles is withdrawn from said containers;

means for detaching a developed film unit from a spindle which has completed passage through the processing cycle; and means for controlling and timing the operation of the machine so that film units retained on the lower free ends of said spindles are progressively raised off of said film unit supporting means, moved a distance along said path corresponding to the distance between adjacent containers, immersed in the photographic solutions for a predetermined period of time and removed by the detaching means at the end of a processing cycle.

2. A film disc developing machine as claimed in claim 1 for processing a film unit contained in a photographic cartridge assembly consisting of two shallow-dished members secured together around their peripheries further comprising:

means for receiving the cartridge assembly;

means for splitting the cartridge assembly apart; and means for delivering said film unit to said film unit supporting means in a substantially horizontal position.

3. A film disc developing machine as claimed in claim 2 wherein:

said means for receiving the cartridge assembly comprises an aperture accessible from the outside of said casing and a rotatable disc-shaped member arranged in said casing to receive a cartridge assembly inserted through said aperture in a substantially horizontal position; and further comprising;

means to rotate said disc-shaped member intermittently about a vertical axis through a plurality of stations;

said means for splitting the cartridge assembly being disposed at one of said stations and comprising means for separating the dish-shaped members and raising the upper dish-shaped member off of the lower dish-shaped member;

said means for supporting a film unit being disposed at a subsequent one of said stations; and means at a further subsequent one of said stations for ejecting the lower dish-shaped member of the cartridge assembly.

4. A film disc developing machine as claimed in any one of claims 1, 2, or 3 and further comprising:

a solution inlet in the lower part of each said solution container;

a solution outlet near the upper part of each said solution container; and means for selectively connecting each said inlet to an outlet of a container containing the same solution in another developing machine.

5. A film disc developing machine as claimed in claim 1 wherein:

said closed paths are circular;

said means for supporting said spindles comprises a carousel member supported at the top of a vertical carousel shaft;

said means for moving said spindles around said path comprises a Geneva wheel attached to the lower end of said carousel shaft and a Geneva pinion operatively engaging said Geneva wheel; and said means for causing said relative vertical movement between said spindle supporting means and said containers and film unit supporting means comprises, a cam follower on said carousel shaft, and a cam operatively engaging said cam follower to raise and lower said shaft;

said Geneva wheel and pinion being adapted to index said carousel shaft through a predetermined angle each time said shaft is raised.

6. A film disc developing machine as claimed in claim 4 wherein:

said closed paths are circular;

said means for supporting said spindles comprises a carousel member supported at the top of a vertical carousel shaft;

said means for moving said spindles around said path comprises a Geneva wheel attached to the lower end of said carousel shaft and a Geneva pinion operatively engaging said Geneva wheel; and said means for causing said relative vertical movement between said spindle supporting means and said containers and film unit supporting means comprises, a cam follower on said carousel shaft, and a cam operatively engaging said cam follower to raise and lower said shaft.

7. A film developing machine as claimed in claim 1 wherein said means to rotate said spindles comprises:

a pulley on each spindle;

a common driving belt operatively engaging the pulleys on said spindles in the positions over said containers; and an electric motor operatively engaging said belt.

8. A film developing machine as claimed in claim 5 wherein said means to rotate said spindles comprises:

a pulley on each spindle;

a common driving belt operatively engaging the pulleys on said spindles in the positions over said containers; and an electric motor operatively engaging said belt.

9. A film developing machine as claimed in claim 6 wherein said means to rotate said spindles comprises:

a pulley on each spindle;

a common driving belt operatively engaging the pulleys on said spindles in the positions over said containers; and an electric motor operatively engaging said belt.

10. A film disc developing machine as claimed in claim 1 and further comprising:

a drying container included in said path of containers and containing no solution;

means for drying a film unit in said drying container; and means for rotating any spindle within said drying container at a high enough speed to throw off excess solution on the film disc and hub thereof.

11. A film disc developing machine as claimed in claim 9 and further comprising:

a drying container included in said path of containers and containing no solution;

means for drying a film unit in said drying container; and means for rotating any spindle within said drying container at a high enough speed to throw off excess solution on the film disc and hub thereof.

* * * * *